US007982560B2

(12) United States Patent
Hesselbarth

(10) Patent No.: US 7,982,560 B2
(45) Date of Patent: Jul. 19, 2011

(54) CAVITY RESONATOR HAVING A RE-ENTRANT STUB ON A PRINTED CIRCUIT BOARD WITH CUT-OUT AREAS

(75) Inventor: Jan Hesselbarth, Zurich (CH)

(73) Assignee: Alcatel-Lucent USA Inc., Murray Hill, NJ (US)

( * ) Notice: Subject to any disclaimer, the term of this patent is extended or adjusted under 35 U.S.C. 154(b) by 274 days.

(21) Appl. No.: 12/261,423

(22) Filed: Oct. 30, 2008

(65) Prior Publication Data

US 2009/0128263 A1 May 21, 2009

(30) Foreign Application Priority Data

Oct. 31, 2007 (EP) ..... 07119809

(51) Int. Cl.
*H01P 7/08* (2006.01)
*H01P 1/205* (2006.01)

(52) U.S. Cl. ..... 333/222; 333/204; 333/223

(58) Field of Classification Search ..... 333/204, 333/205, 219, 222, 223, 230, 235
See application file for complete search history.

(56) References Cited

U.S. PATENT DOCUMENTS 2,964,718 A * 12/1960 Packard ..... 333/204
2,968,012 A * 1/1961 Alstadter ..... 333/205
5,045,825 A * 9/1991 McJunkin ..... 333/222
5,157,364 A * 10/1992 Pond et al. ..... 333/203
5,278,528 A * 1/1994 Turunen ..... 333/203
5,801,605 A * 9/1998 Filakovsky ..... 333/203
2003/0034124 A1 2/2003 Sugaya et al.
2003/0112100 A1 6/2003 Harron et al.

FOREIGN PATENT DOCUMENTS

JP 57 097203 A 6/1982
WO WO 2006/029868 A1 3/2006

OTHER PUBLICATIONS

Yau et al., "Effects on Tuning Structures on Combline Filters,", European Microwave Conference 1996, Prague, pp. 427-430, Sep. 1996.
Brown A. R. et al., "A Varactor-Tuned RF Filter," IEEE Transactions on Microwave Theory and Techniques, IEEE Service Center, Piscataway, NJ, vol. 48, No. 7, pp. 1157-1160, Jul. 2000.
European Search Report, Feb. 14, 2008.

* cited by examiner

*Primary Examiner* — Benny Lee
(74) *Attorney, Agent, or Firm* — Fay Sharpe LLP

(57) ABSTRACT

The invention is related to cavity resonators, a method for producing a cavity resonator, and a band pass filter system comprising cavity resonators. A cavity resonator (100) according to the invention comprises a printed circuit-board (10); an upper electrically conductive cap (20) having a three-dimensional structure (21); and a lower electrically conductive cap (30) having a three-dimensional structure (31). The structures of the upper cap (20) and the lower cap (30) are identical and the two caps (20, 30) are mounted on opposite sides of the printed circuit-board (10).

19 Claims, 5 Drawing Sheets

FIG. 3a
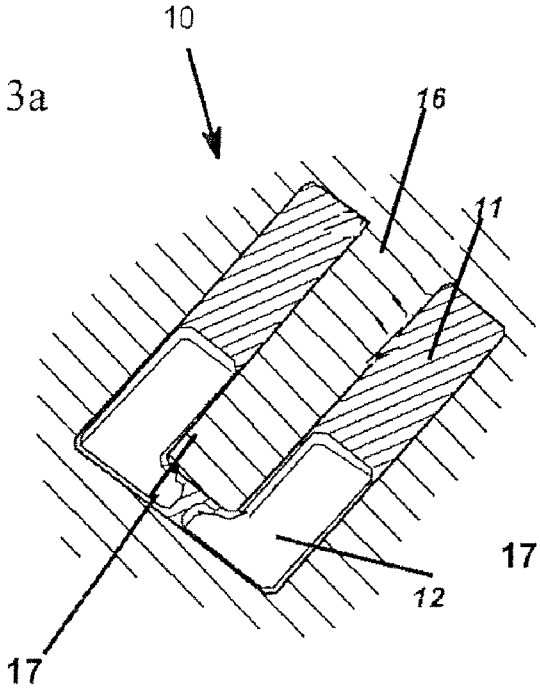
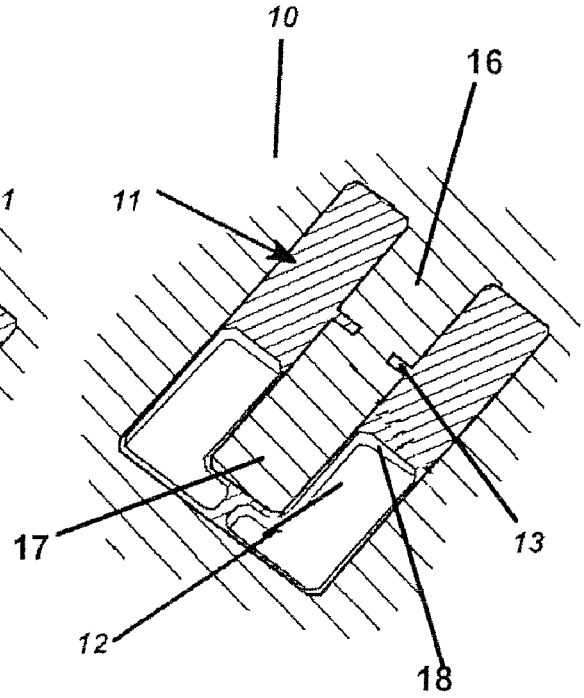
FIG. 3b

CAVITY RESONATOR HAVING A RE-ENTRANT STUB ON A PRINTED CIRCUIT BOARD WITH CUT-OUT AREAS

BACKGROUND

The invention is related to cavity resonators, a method for producing a cavity resonator, and a band pass filter system comprising cavity resonators.

Cavity resonators are resonators where the radio frequency electromagnetic energy resonates in an empty volume, typically air or vacuum, this volume being surrounded by metal.

The size of a cavity resonator depends on the frequency of operation. At microwave frequencies (0.3 GHz-30 GHz), size and weight of cavity resonators are significant. They are typically milled in or cast from metal. Since the geometrical shape determines the frequency of resonance, high mechanical accuracy is required and/or post-production tuning is applied. Post-production tuning is usually achieved by placing a metallic tuning screw through the resonator wall, and turning it, causing suitable field distortion and thereby resonance frequency variation.

Cavity resonator filters combine several resonators in order to obtain sophisticated frequency selective behavior.

It turns out that cavity resonators and filters based thereof are large, weighty, expensive parts which are not well suited to mass production. They are nevertheless used because of their superior performance in terms of energy losses and high power handling capability.

A well known method to reduce the size of a cavity working at a given frequency is the shape of a "re-entrant cavity", where the electric and magnetic parts of the electromagnetic field are essentially geometrically separated and the electric field volume is reduced in a capacitor. A tuning screw allowing resonance frequency correction is placed in the capacitive gap.

Cavity resonator filters made of metalized plastics may have advantages in terms of weight and cost. Metalized plastics cavity resonator filters have been used for surface-mount soldering onto printed circuit boards, thereby forming the cavity at one side by the surface metallization of the printed circuit board.

Problems occurring in the realization of surface-mount compatible cavity resonators and related filter systems are too high production tolerances (alignment, solder thickness) in the surface-mount and soldering process of the cavity parts and the printed circuit board.

Cavity filters consisting of a multitude of cavity resonators become inexpensive when produced in quantities, by using injection molded, metalized plastic parts. However, the molding form represents a big non-recurrent cost. Hence, all resonators of a given multi-resonator filter need to be based on the same molded parts.

A remaining drawback of this approach is that two or three different molded parts are actually required to build a resonator.

Another drawback of this above approach is that if an electronic tuning means (such as varactor diodes, MEMS devices) is to be placed onto the printed circuit board (PCB) inside the resonator, this device may be restricted in its impact as the geometrical position of the printed circuit board in the resonator may not be well suited for the tuning functionality.

SUMMARY OF THE INVENTION

It is the aim of this invention to come up with a cavity resonator, a method for production of such resonator, and a band-pass filter system with low production costs, a reduced number of different parts, a high production precision, and the possibility of placing electronic tuning means.

The aim is achieved by a cavity resonator, a method and a band-pass filter.

A cavity resonator is proposed comprising a printed circuit-board, an upper electrically conductive cap having a three-dimensional structure, and a lower electrically conductive cap having a three-dimensional structure. In accordance with the invention, the structures of the upper and lower caps are identical, and the two caps are mounted on opposite sides of the printed circuit-board.

Such cavity resonators, and hence re-entrant cavity filters, may be manufactured in an economic way by using surface-mount solder technology. All resonators of a given filter make use of one single molding form, reducing significantly the non-recurrent cost of molding forms. Only a single molding form is required for a resonator.

The orientation of the printed circuit board gives a larger degree of freedom of where to place frequency tuning devices inside the resonator. Tuning elements can be added to the resonators, leading to electronically tunable cavity filters to be produced completely in surface-mount technology.

Preferably, the printed circuit board consists of a layer structure comprising a conductive layer and a dielectric layer.

The conductive layer may form a re-entrant stub. This stub extends into the cavity of the resonator. The conductive material of the stub forms a gap with the surrounding conductive material of the printed circuit board so that the stub enters into the cavity and is electrically connected to the remaining conductive layer on the printed circuit board at least at one end.

In one embodiment, the printed circuit board comprises one or more cut-out areas of the printed circuit board adjacent to the re-entrant stub. Such cut-out areas lead to a decrease of dissipative losses due to the dielectric in an area with strong electric fields.

In another embodiment of the invention, the re-entrant stub may have at least one notch. Such notches, e.g. etched-away notches in the conductive layer only or through all layers, make the current path longer and therefore reduce the resonance frequency of the resonator.

In a further embodiment of the invention, at least one dielectric element is arranged between a conductive cap and the printed circuit board. Such dielectric elements are preferably spheres and are arranged between both caps and the circuit board within the capacitive gaps. These areas are tolerance-critical, and high manufacturing precision can be achieved in this way. The dielectric may consist e.g. of quartz.

The geometry of the conductive layer may be achieved by etching.

The cavity resonator according to the invention may comprise means for tuning the resonator frequency. The proposed design of the PCB gives a large degree of freedom of where to place electronic tuning devices inside the resonator. This leads to the possibility to design, e.g., varactor-tunable cavity resonator filters, which can be produced entirely in surface-mount soldering technology.

Such tuning means are preferably arranged between the re-entering stub, i.e. the element placed inside the cavity and the surrounding conductive layer, within the non-conductive area in between.

Such means may be e.g. a varactor diode. To be able to apply DC bias, a blocking capacitor may be needed. The elements may be placed in a location of small electric fields, thereby reducing the influence of the varactor capacitance on the resonance frequency, but keeping the resonator quality factor high and only slightly reduced by the varactor's dissipative losses.

Alternatively, the varactor may be placed at locations of higher electric fields, leading to an increased range of the resonance frequency, but deteriorates the resonator quality factor to a larger extent. The DC bias line may be a trace in the embedded conductor layer of the printed circuit board connecting through a via-hole to the location between the varactor and the capacitor.

The upper electrically conductive cap and/or the lower electrically conductive cap of a cavity resonator according to the invention may consist at least partially of metalized plastics.

The invention provides further for a method for producing a cavity resonator comprising the step of arranging a printed circuit-board, between an upper electrically conductive cap having a three-dimensional cap structure and an identical lower electrically conductive cap having a three-dimensional cap structure such that the two caps are mounted on opposite sides of the printed circuit board.

Within this method, the printed circuit board may consist of a layer structure comprising a conductive layer and a dielectric layer.

Preferably, the conductive layer forms a re-entrant stub.

In one embodiment of the invention, the printed circuit board comprises one or more cut-out areas adjacent to the re-entrant stub.

The method may include a re-entrant stub which has at least one notch.

In another embodiment, the method comprises at least one dielectric element which is arranged between a conductive caps and the printed circuit board.

One aim of the invention is further achieved by a band-pass filter system, comprising several cavity resonators of the types described above.

BRIEF DESCRIPTION OF THE DRAWINGS

In the following, selected embodiments of the invention are described with reference to the accompanying drawings:

FIGS. 3*a* and 3*b* show a partial, perspective view of two embodiments of a resonator circuit board;

Figure 1:
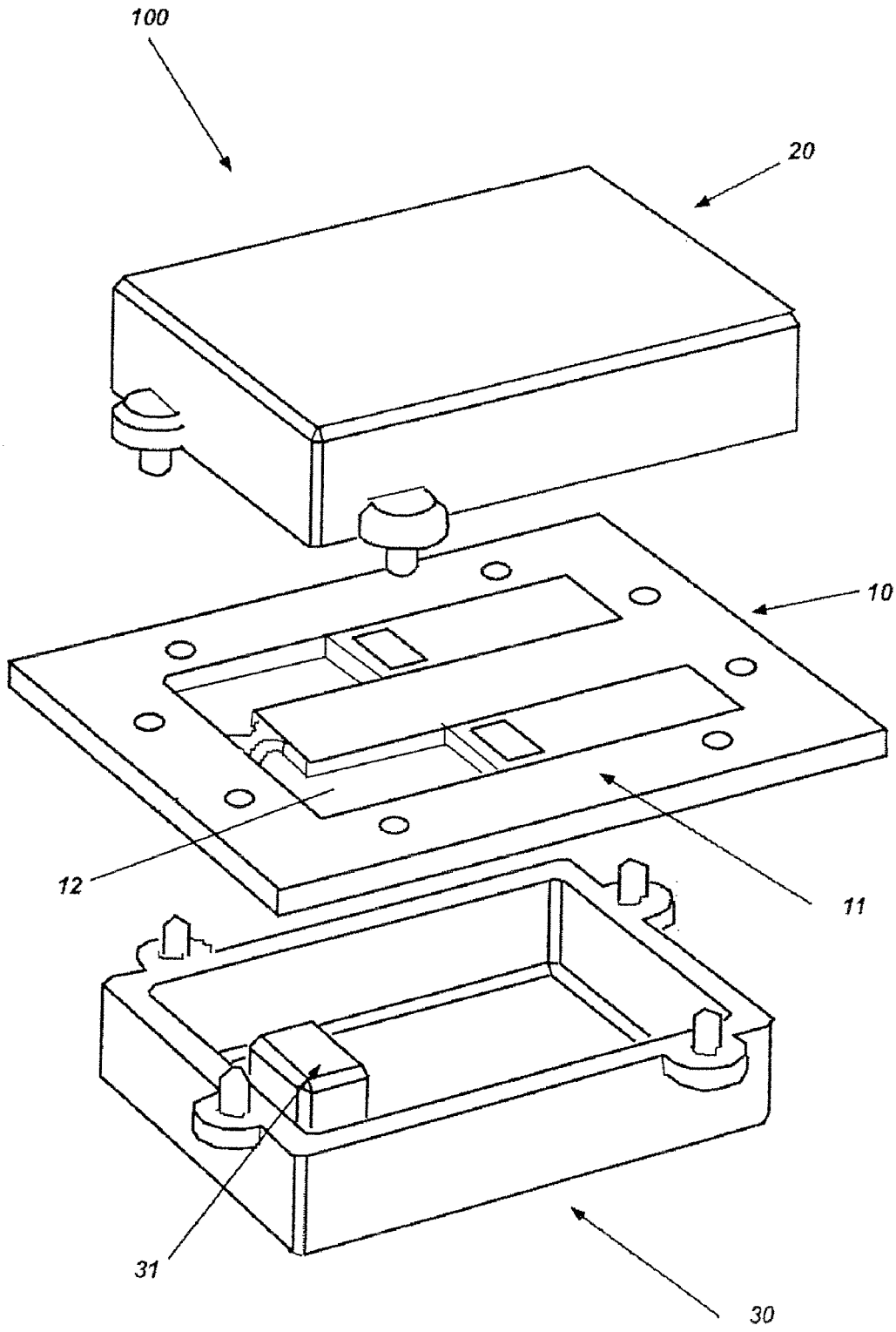
FIG. 1 shows a perspective view of a resonator according to the invention.

It is to be understood that the drawings shall schematically illustrate the invention but shall not be limiting for the scope of the invention.

DETAILED DESCRIPTION OF THE INVENTION

One or more implementations of the present disclosure will now be described with reference to the attached drawings, wherein like reference numerals are used to refer to like elements throughout.

As can be seen in FIG. 1, a cavity resonator 100 comprises a printed circuit board 10 and two electrically conductive caps, an upper cap 20 and a lower cap 30. Both caps have a three-dimensional structure here visible at reference numeral 31 on the lower cap 30. The two caps are identical and are mounted on opposite sides of the printed circuit board. Only a single molding form is required for a resonator. The board has areas 11 where the conductive layer is etched away and two cut-out areas 12.

Figure 2:
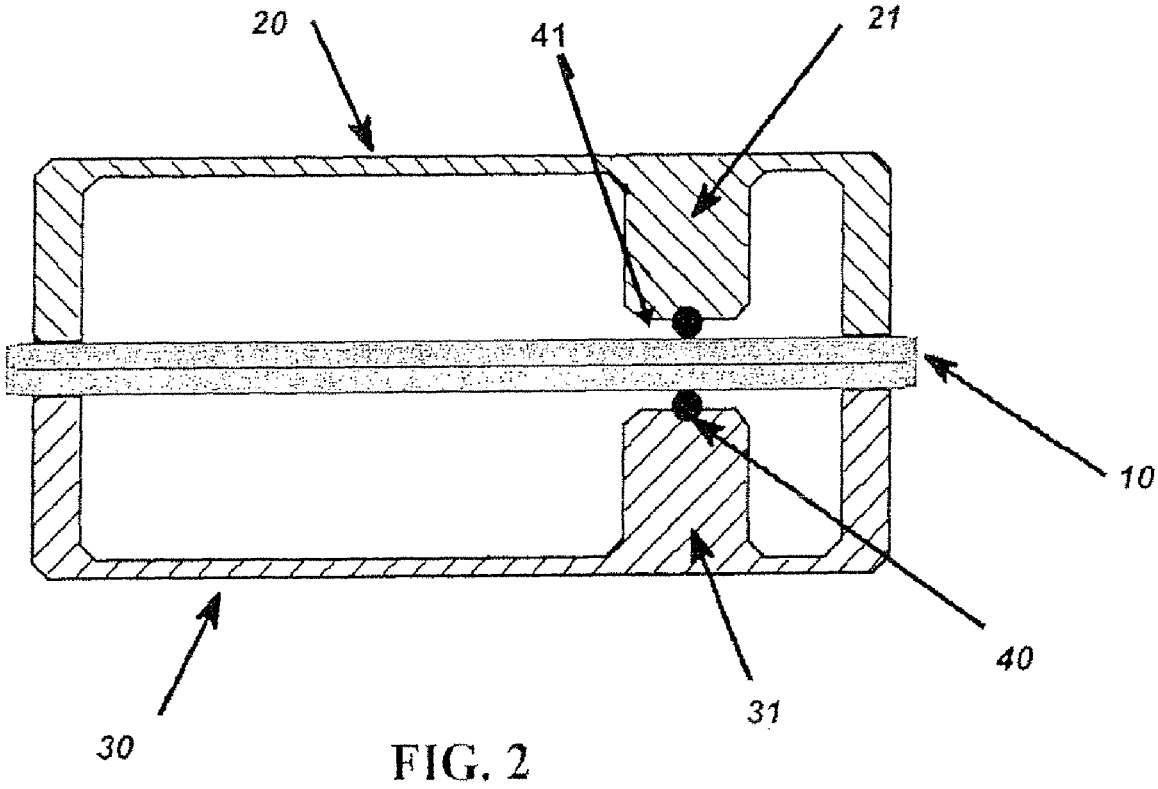
FIG. 2 shows a cross section view of a resonator according to the invention.

FIG. 2 shows a cross section view of a resonator according to the invention. Two caps 20, 30 are mounted on both sides of the printed circuit board 10. The structure of the caps is identical. Both caps are molded parts consisting of metalized plastic material. In order to achieve highest accuracy in manufacturing the resonator there are dielectric spheres 40, made of quartz in this instance, placed between the inner structures 21, 31 of the caps 20, 30 and the printed circuit board. In this way, the tolerance-critical capacitive gaps 41 may be maintained at a selected value.

FIGS. 3*a* and 3*b* show partial perspective views of two different embodiments of a resonator electric circuit board 10. It can be seen that the board 10 consists of a layer structure with a top conductor area 16 on a dielectric board. The board has areas 11 where the conductive layer is etched away and two cut-out areas 12 so that a re-entrant stub 17 is formed. In operation, this stub will be loaded by the capacitive gaps (41 in FIG. 2).

FIGS. 3*a* and 3*b* illustrate how the resonator's resonance frequency can be affected by changing the current path length along the re-entrant stub 17. The stub 17 is a feature of the printed circuit board, therefore allowing for using the same molded caps 20, 30 for different resonators in, e.g., a filter. FIG. 3*a* shows an embodiment in which the top conductor area 16 is etched away in two areas 11 on both sides along the re-entrant stub 17 to achieve a given resonance frequency. The embodiment shown in FIG. 3*b* has additional etched-away notches 13 which make the current path longer and therefore reduce the resonance frequency of the resonator.

Both embodiments show cut-out areas 12 of the dielectric, which lead to a decrease of dissipative losses due to the dielectric in an area with strong electric fields.

Figure 4:
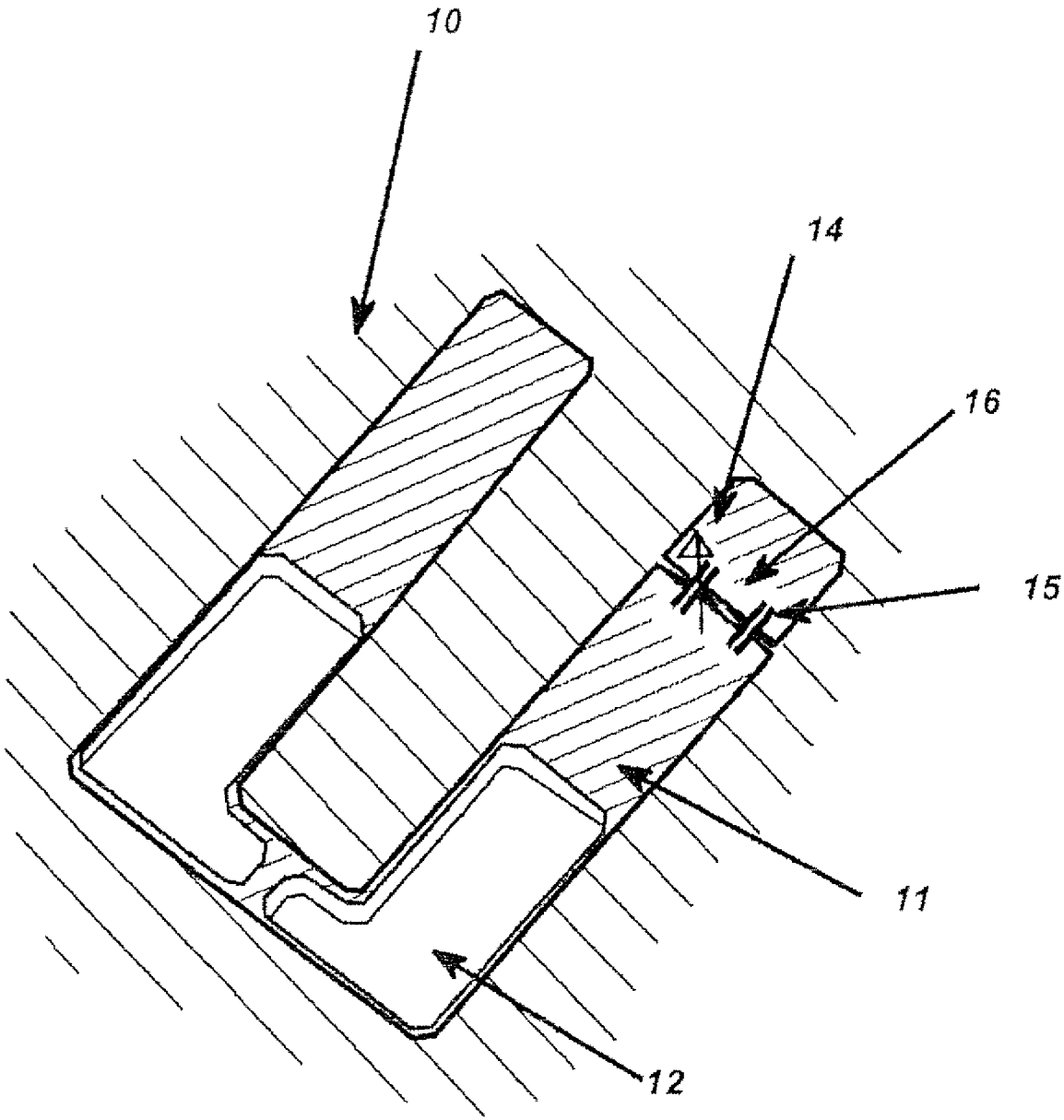
FIG. 4 shows a partial, perspective view of another embodiment of a resonator circuit board.

FIG. 4 shows how a varactor diode 14 can be placed inside a resonator as a means for tuning the resonator frequency. A reverse bias voltage at the diode junction 16 controls the junction capacitance. A variation of the varactor capacitance changes the resonance frequency. By locating the varactor 14 away from the maximum of the electric field in the resonator, the frequency tuning range is reduced, and the degradation of the resonator quality factor due to the dissipative losses of the varactor 14 is limited. At the same time, the power handling capability of the filter determined by the nonlinear effects introduced by the varactor at large field magnitudes is increased.

In order to apply DC bias, a blocking capacitor 15 is needed.

The proposed resonator structure allows choosing the varactor based on the trade-off between required frequency tuning range and acceptable quality factor degradation as well as power handling capability, which is due to the characteristics of the varactor diode.

Figures 5A, 5B:
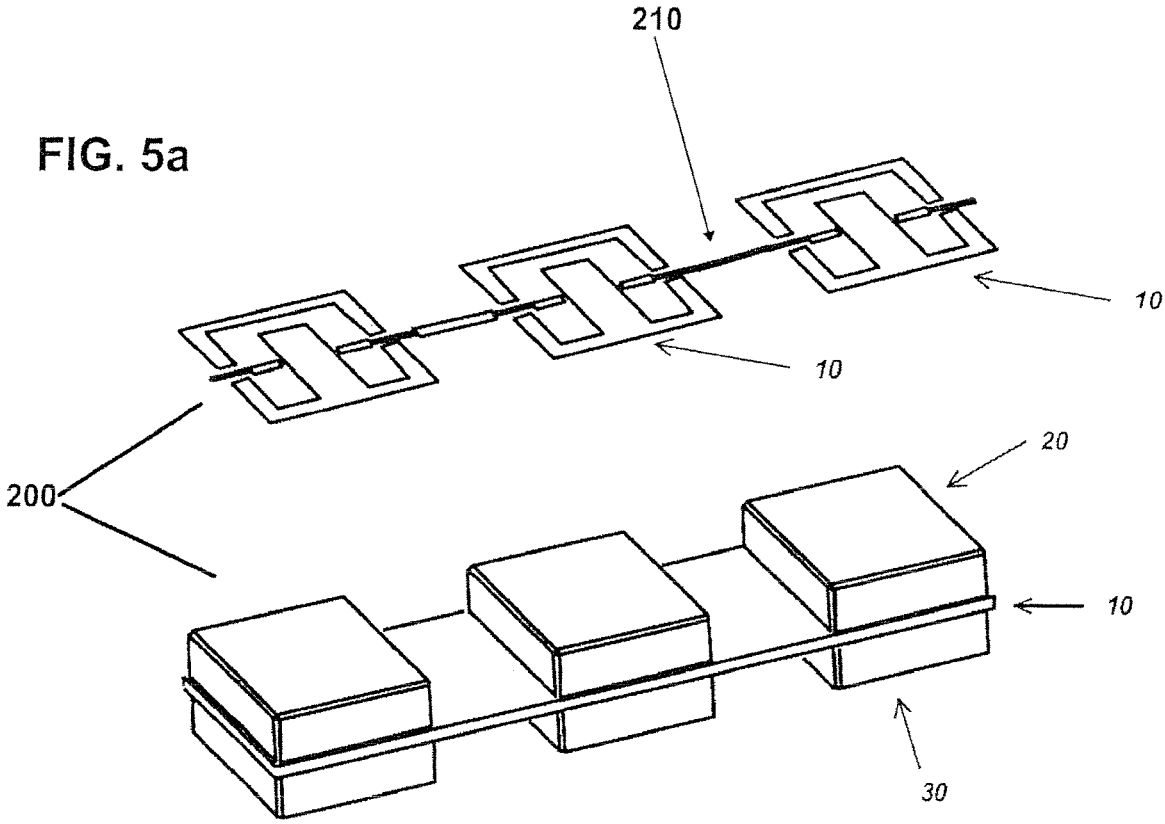
FIGS. 5*a* and 5*b* show a perspective view of three resonators connected to form a bandpass filter.

FIGS. 5*a* and 5*b* show how three resonators are connected to form a bandpass filter 200. FIG. 5*a* shows the center conductor pattern of a three-layer printed circuit board 10. The three resonators have slightly different resonance frequencies, and it is the stripline structure shown in FIG. 5*a* together with the top and bottom conductor layers of the PCB which realizes these differences in resonance frequency. The coupling between separate resonators is done by stripline 210 shown in FIG. 5*a*. It realizes the coupling between the resonators as well as the input/output couplings. Different couplings required for specific filter characteristics can be realized by adapting the stripline structure.

FIG. 5*b* shows the entire filter consisting of three resonators with printed circuit board and upper and lower caps 20, 30.

Only a single molding form is required for such a filter, resulting in considerable savings.

REFERENCE NUMERALS LIST

10 printed circuit board
12 cut-out area
13 notch
15 blocking capacitor
14 resonator frequency tuning means/varactor diode
15 blocking capacitor
16 conductive layer
17 re-entrant stub
18 dielectric layer
20 upper cap
21 three dimensional structure of upper cap
30 lower cap
31 three dimensional structure of lower cap
40 dielectric element
41 capacitive gap
100 cavity resonator
200 band pass filter system
210 stripline

The invention claimed is:

1. A cavity resonator comprising:

a printed circuit-board;

an upper electrically conductive cap having a three-dimensional structure; and a lower electrically conductive cap having a three-dimensional structure; wherein the structures of the upper cap and the lower cap are identical and the upper and lower caps are mounted on opposite sides of the printed circuit-board;

wherein the printed circuit-board includes a layer structure comprising a conductive layer and a dielectric layer;

wherein the layer structure of the printed circuit-board includes a re-entrant stub and a first area laterally adjacent to a first portion of a first side of the re-entrant stub and the first area having no conductive layer;

wherein the re-entrant stub has at least one notch; and wherein the printed circuit board comprises a first cut-out area that is laterally adjacent to a second portion of the first side of the re-entrant stub.

2. The cavity resonator of claim 1, wherein the first cut-out area defines a gap through both the conductive layer and the dielectric layer of the layer structure.

3. The cavity resonator of claim 1, wherein the first cut-out area and a second cut-out area both define a gap through both the conductive layer and the dielectric layer of the layer structure having no conductive layer that is laterally adjacent to the re-entrant stub on both the first side and a second side of the re-entrant stub respectively, wherein the first side and the second side are located at opposite and adjacent sides that extend along a longitudinal direction of the re-entrant stub and in a lateral direction towards one another along a third side of the re-entrant stub without connecting.

4. The cavity resonator according to claim 1, wherein at least one means for tuning the resonator frequency is arranged between the stub and the conductive layer of the printed circuit board.

5. The cavity resonator according to claim 4, wherein the at least one means for tuning the resonator frequency comprises at least one varactor diode.

6. The cavity resonator of claim 1, wherein the layer structure includes a second area laterally adjacent to a second portion of the first side along the re-entrant stub.

7. The method according to claim 6, wherein the dielectric element includes a quartz material shaped as a sphere.

8. Band-pass filter system, comprising several cavity resonators according to claim 1.

9. Band-pass filter system according to claim 8, wherein the coupling between separate resonators is provided by a stripline which is part of the printed circuit board of the resonators.

10. The cavity resonator according to claim 1, wherein at least one dielectric element is arranged between one of said upper and lower conductive caps and the printed circuit board.

11. The cavity resonator according to claim 10, wherein the at least one dielectric element includes a quartz sphere between the one of said upper and lower conductive caps and the printed circuit board.

12. The cavity resonator of claim 1, wherein the first cut-out area of the printed circuit-board is laterally adjacent to the second portion of the re-entrant stub and to the first area.

13. The cavity resonator of claim 1, comprising a second cut-out area extending laterally alongside a second side of the re-entrant stub that is opposite the first side, and extending partially alongside a third side of the re-entrant stub that intersects the first side and the second side.

14. A method for producing a cavity resonator comprising:

arranging a printed circuit-board, between an upper electrically conductive cap having a three-dimensional cap structure and an identical lower electrically conductive cap having a three-dimensional cap structure such that the upper and lower caps are mounted on opposite sides of the printed circuit board, wherein the printed circuit-board consists of a layer structure comprising a conductive layer and a dielectric layer;

forming a re-entrant stub having the conductive layer and the dielectric layer including:

partially removing the conductive layer from the printed circuit-board to form a first non-conductive area and a second non-conductive area alongside a first portion of the re-entrant stub;

forming one or more cut-out areas in the layer structure of the printed circuit board adjacent the re-entrant stub; and forming at least one notch in the re-entrant stub.

15. The method according to claim 14, wherein forming the one or more cut-out areas adjacent the re-entrant stub includes forming a first gap and a second gap through the conductive layer and the dielectric layer of the structure layer that extends laterally adjacent to the re-entrant stub on a first side and a second side which are opposite to each other in a longitudinal direction and in a lateral direction toward one another along a different third side of the re-entrant stub without connecting.

16. The method according to claim 14, providing a dielectric element between the printed circuit board and the upper cap and between the printed circuit board and the lower cap.

17. The method of claim 14, wherein forming the one or more cut-out areas includes forming a first cut-out area laterally adjacent the re-entrant stub that extends in a longitudinal direction alongside a first side of the re-entrant stub and adjacent to the first area.

18. The method of claim 17, comprising:

forming a second cut-out area opposite the first cut-out area and laterally adjacent the re-entrant stub that extends in the longitudinal direction alongside a second side of the re-entrant stub and adjacent the second area.

19. The method of claim 18, comprising:

forming the first and the second cut-out area in a lateral direction toward one another along a third side of the re-entrant stub that intersects the first side and the second side.

* * * * *